US005458809A

United States Patent [19]

Fredj et al.

[11] Patent Number: 5,458,809

[45] Date of Patent: Oct. 17, 1995

[54] SURFACTANT-CONTAINING DYE TRANSFER INHIBITING COMPOSITIONS

[75] Inventors: Abdennaceur Fredj, Brussels; James P. Johnston, Overijse; Christiaan A. J. Thoen, Haasdonk, all of Belgium

[73] Assignee: The Procter & Gamble Co., Cincinnati, Ohio

[21] Appl. No.: 373,196

[22] PCT Filed: Jun. 30, 1993

[86] PCT No.: PCT/US93/06223

§ 371 Date: Jan. 17, 1995

§ 102(e) Date: Jan. 17, 1995

[87] PCT Pub. No.: WO94/02580

PCT Pub. Date: Feb. 3, 1994

[30] Foreign Application Priority Data

| | | | |
|---|---|---|---|
| Jul. 15, 1992 | [EP] | European Pat. Off. | 92202168 |
| Nov. 6, 1992 | [EP] | European Pat. Off. | 92870182 |
| Apr. 26, 1993 | [EP] | European Pat. Off. | 93201198 |
| Jun. 9, 1993 | [EP] | European Pat. Off. | 93870106 |

[51] Int. Cl.[6] ..... C11D 3/37; C11D 1/00

[52] U.S. Cl. ..... 252/542; 252/547; 252/174.24; 252/DIG. 2; 525/326.7

[58] Field of Search ..... 252/542, 547, 252/174.24, DIG. 2; 525/326.7

[56] References Cited

U.S. PATENT DOCUMENTS

| | | | |
|---|---|---|---|
| 3,159,611 | 12/1964 | Dunn et al. | 260/88.3 |
| 4,234,377 | 11/1980 | Pezzoli | 162/3 |
| 4,548,744 | 10/1985 | Connor | 252/545 |
| 4,698,171 | 10/1987 | Bertini et al. | 252/60 |
| 5,009,980 | 4/1991 | El-Sayed et al. | 430/114 |
| 5,298,289 | 3/1994 | Lindert et al. | 427/388.4 |

FOREIGN PATENT DOCUMENTS

| | | |
|---|---|---|
| 1097450 | 1/1968 | United Kingdom . |

OTHER PUBLICATIONS

Klockars, Arch. Environ. Health, Effect of two particle surface modifying agents, No Month Available 1990 vol. 45(1), pp. 8–14.

*Primary Examiner*—Paul Lieberman
*Assistant Examiner*—Michael P. Tierney
*Attorney, Agent, or Firm*—Michael D. Jones; Jerry J. Yetter; Jacobus C. Rasser

[57] ABSTRACT

The present invention relates to dye transfer inhibiting compositions comprising: a) a polymer selected from polyamine N-oxide containing polymers which contain units having the structure formula (I), wherein P is a polymerizable unit, whereto the N—O group can be attached to or wherein the N—O group forms part of the polymerizable unit or a combination of both; A is (a), (b), (c), —O—, —S—, (d); x is =0 or 1; R are aliphatic, ethoxylated aliphatic, aromatic, heterocyclic or alicyclic groups or any combination thereof whereto the nitrogen of the N—O group can be attached or wherein the nitrogen of the N—O group form part of these groups; b) a surfactant system comprising a surfactant selected from nonionic and/or anionic and/or cationic and/or ampholytic and/or zwitterionic and/or semi-polar surfactants.

8 Claims, No Drawings

SURFACTANT-CONTAINING DYE TRANSFER INHIBITING COMPOSITIONS

FIELD OF THE INVENTION

The present invention relates to a composition and a process for inhibiting dye transfer between fabrics during washing. More in particular, this invention relates to dye transfer inhibiting compositions comprising polyamine N-oxide containing polymers and surfactants.

BACKGROUND OF THE INVENTION

Detergent compositions useful for cleaning purposes, such as laundering of fabrics, have commonly utilized a variety of surfactants.

The ability of detergent compositions to clean a large variety of soils and stains from other fabrics present in the typical load of laundry is of high importance in the evaluation of detergent performance. Each surfactant has both strenghts and weaknesses. Consequently, detergent compositions are formulated with more than one surfactant active in order to maximize advantages and minimize disadvantages.

The relative ability of each surfactant to meet various performance criteria is among others depending on the presence of adjunct detergent ingredients.

One of the types of adjunct detergent ingredients that is added to detergent compositions are dye transfer inhibiting polymers.

Said polymers are added to detergent compositions in order to inhibit the transfer of dyes from colored fabrics onto other fabrics washed therewith. These polymers have the ability to complex or adsorb the fugitive dyes washed out of dyed fabrics before the dyes have the opportunity to become attached to other articles in the wash.

Polymers have been used within detergent compositions to inhibit dye transfer. Copending European Patent Application No. 92202168.8. describes polyamine N-oxide containing polymers which are very efficient in eliminating transfer of solubilized or suspended dyes.

It has now been found that polyamine N-oxide containing polymers are very compatible with surfactant systems. In addition, it has been found that the dye transfer inhibiting performance has been increased in the presence of certain surfactants.

This finding allows us to formulate detergent compositions which have both excellent dye transfer inhibiting properties and overall detergency performance.

According to another embodiment of this invention a process is also provided for laundering operations involving colored fabrics.

SUMMARY OF THE INVENTION

The present invention relates to inhibiting dye transfer compositions comprising a polymer selected from polyamine N-oxide containing polymers which contain units having the following structure formula (I):

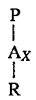

(I)

wherein P is a polymerisable unit, whereto the N—O group can be attached to or wherein the N—O group forms part of the polymerisable unit or a combination of both.

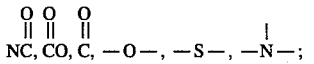

R are aliphatic, ethoxylated aliphatics, aromatic, heterocyclic or alicyclic groups or any combination thereof whereto the nitrogen of the N—O group can be attached or wherein the nitrogen of the N—O group form part of these groups and a surfactant system.

DETAILED DESCRIPTION OF THE INVENTION

The compositions of the present invention comprise as an essential element polyamine N-oxide containing polymers which contain units having the following structure formula:

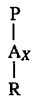

(I)

wherein P is a polymerisable unit, whereto the R—N—O group can be attached to or wherein the R—N—O group forms part of the polymerisable unit or a combination of both.

A is

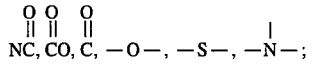

x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

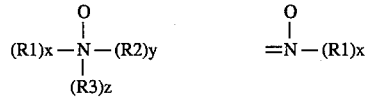

wherein R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine N-oxide containing polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymers can be obtained in almost any degree of polymerisation. The degree of polymerisation is not critical provided the material has the desired water-solubility and dye-suspending power.

Typically, the average molecular weight of the polyamine N-oxide containing polymers is within the range of 500 to 1000,000; preferably from 1,000 to 50,000, more preferably from 2,000 to 30,000, most preferably from 3,000 to 20,000.

The polyamine N-oxide containing polymers of the present invention are typically present from 0,001% to 10% , more preferably from 0.01% to 2%, most preferred from 0.05% to 1% by weight of the dye transfer inhibiting composition.

The present compositions are conveniently used as additives to conventional detergent compositions for use in laundry operations. The present invention also encompasses dye transfer inhibiting compositions which will contain detergent ingredients and thus serve as detergent compositions.

Methods for making polyamine N-oxides:

The production of the polyamine N-oxide containing polymers may be accomplished by polymerizing the amine monomer and oxidizing the resultant polymer with a suitable oxidizing agent, or the amine oxide monomer may itself be polymerized to obtain the polyamine N-oxide.

The synthesis of polyamine N-oxide containing polymers can be exemplified by the synthesis of polyvinyl-pyridine N-oxide. Poly-4-vinylpyridine ex Polysciences (mw. 50,000, 5.0 g., 0.0475 mole) was predisolved in 50 ml acetic acid and treated with a peracetic acid solution (25 g of glacial acetic acid, 6.4 g of a 30% vol. solution of $H_2O_2$, and a few drops of $H2SO_4$give 0.0523 mols of peracetic acid) via a pipette. The mixture was stirred over 30 minutes at ambient temperature (32 C.). The mixture was then heated to 80–85 C. using an oil bath for 3 hours before allowing to stand overnight. The polymer solution then obtained is mixed with 11 of acetone under agitation. The resulting yellow brown viscous syrup formed on the bottom is washed again with 11 of aceton to yield a pale crystalline solid.

The solid was filtered off by gravity, washed with acetone and then dried over $P_2O_5$.

The amine: amine N-oxide ratio of this polymer is 1:4 (determined by NMR).

SURFACTANT SYSTEM:

The compositions according to the present invention comprise in addition to the polyamine-N-oxide containing polymers a surfactant system wherein the surfactant can be selected from nonionic and/or anionic and/or cationic and/or ampholytic and/or zwitterionic and/or semi-polar surfactants.

Preferred surfactant systems to be used according to the present invention comprise as a surfactant one or more of the nonionic surfactants described herein. These nonionic surfactants have found to be very useful in that the dye transfer inhibiting performance of the polyamine N-oxide containing polymers has been increased in the presence of said surfactants.

NONIONICS:

Polyethylene, polypropylene, and polybutylene oxide condensates of alkyl phenols are suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 5 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23–6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide) marketed by Shell Chemical Company, and Kyro™ EOB (the condensation product of $C_{13}$–$C_{15}$ alcohol with 9 moles ethylene oxide), marketed by The Procter & Gamble Company.

Also useful as the nonionic surfactant of the surfactant systems of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Although not preferred, the condensation products of ethylene oxide with a hydrophobic base formed by the condensation of propylene oxide with propylene glycol are also suitable for use as the additional nonionic surfactant of the nonionic surfactant systems of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydoxy fatty acid amide surfactants.

Also suitable as nonionic surfactants are poly hydroxy fatty acid amide surfactants of the formula $$R^2-\underset{\underset{O}{\|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight C1-15 alkyl or alkenyl chain such as coconut alkyl or mixtures thereof, and Z is derived from a reducing sugar such as glucose, fructose, maltose, lactose, in a reductive amination reaction.

When included in such laundry detergent compositions, the nonionic surfactant systems of the present invention act to improve the greasy/oily stain removal properties of such laundry detergent compositions across a broad range of laundry conditions.

ANIONIC SURFACTANTS

Suitable anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)M), $C_{12}$–$C_{18}$ alkyl polyethoxylate (2.25) sulfate ($C_{12}$–$C_{18}$E(2.25)M) , $C_{12}$–$C_{18}$ alkyl polyethoxylate (3.0) sulfate ($C_{12}$–$C_{18}$E(3.0)M), and $C_{12}$–$C_{18}$ alkyl polyethoxylate (4.0) sulfate ($C_{12}$–$C_{18}$E(4.0)M) , wherein M is conveniently selected from sodium and potassium.

Suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

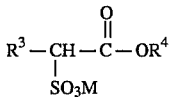

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16\text{-}18}$ alkyl chains are preferred for higher wash temperatures (e.g. above about 50° C.).

Other anionic surfactants useful for detersive purposes can also be included in the laundry detergent compositions of the present invention. These can include salts ( including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—CH2COO-M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

The laundry detergent compositions of the present invention may also contain cationic, ampholytic, zwitterionic, and semi-polar surfactants, as well as nonionic surfactants other than those already described herein.

Preferred cationic surfactant systems include nonionic and ampholytic surfactants. Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N+X-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred cationic surfactants are the water-soluble quaternary ammonium compounds useful in the present composition having the formula:

$$R_1R_2R_3R_4N^+X^- \quad \text{(i)}$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of R2, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12}$-15 dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl $(ethenoxy)_4$ ammonium chloride or bromide; choline esters (compounds of formula (i) wherein $R_1$ is $$-CH_2-O-\underset{\underset{O}{\|}}{C}-C_{12-14}$$

alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980.

When included therein, the laundry detergent compositions of the present invention typically comprise from 0% to about 25%, preferably from about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

When included therein, the laundry detergent compositions of the present invention typically comprise from 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

When included therein, the laundry detergent compositions of the present invention typically comprise from 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)xN\overset{\overset{O}{|}}{}(R^5)2$$

wherein $R^3$ is an alkyl, hydroxyalkyl, or alkyl phenyl group or mixtures therof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the laundry detergent compositions of the present invention typically comprise from 0% to about 15%, preferably from about 1% to about 10% by weight of such semi-polar nonionic surfactants.

The present invention further provides laundry detergent compositions comprising at least 1% by weight, preferably from about 3% to about 65%, more preferably from about 10% to about 25% by weight of total surfactants.

DETERGENT ADJUNCTS

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran - cis, cis, cis-tetracarboxylates, 2,5-tetrahydrofuran -cis - dicarboxylates, 2,2,5,5-tetrahydrofuran - tetracarboxylates, 1,2,3,4,5, 6-hexane -hexacarboxylates and and carboxymethyl derivatives of polyhydric alcohols such as sorbitol, mannitol and xylitol. Aromatic polycarboxylates include mellitic acid, pyromellitic acid and the phtalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (sks/6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and Na4EDDS. Examples of such preferred magnesium salts of EDDS include MgEDDS and $Mg_2$EDDS. The magnesium salts are the most preferred for inclusion in compositions in accordance with the invention.

Especially for the liquid execution herein, suitable fatty acid builders for use herein are saturated or unsaturated C10–18 fatty acids, as well as well as the corresponding soaps. Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions the purposes of the invention include inorganic materials such as alkali metal carbonates, bicarbonates, silicates, and organic materials such as the organic phosphonates, amiono polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756.

Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Detergent ingredients that can be included in the detergent compositions of the present invention include bleaching agents. These bleaching agent components can include one or more oxygen bleaching agents and, depending upon the bleaching agent chosen, one or more bleach activators. When present bleaching compounds will typically be present at levels of from about 1% to about 10%, of the detergent composition. In general, bleaching compounds are optional components in non-liquid formulations, e.g. granular detergents. If present, the amount of bleach activators will typically be from about 0.1% to about 60%, more typically from about 0.5% to about 40% of the bleaching composition.

The bleaching agent component for use herein can be any of the bleaching agents useful for detergent compositions including oxygen bleaches as well as others known in the art.

In a method aspect, this invention further provides a method for cleaning fabrics, fibers, textiles, at temperatures below about 50° C., especially below about 40° C., with a detergent composition containing polyamine N-oxide containing polymers, optional auxiliary detersive surfactants, optional detersive adjunct ingredients, and a bleaching agent.

The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

Preferably, the bleaches suitable for the present invention include peroxygen bleaches. Examples of suitable watersoluble solid peroxygen bleaches include hydrogen peroxide releasing agents such as hydrogen peroxide, perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters such as disclosed in Copending European Patent Application No. 91870207.7.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0,025% to about 1.25%, by weight, of sulfonated zinc phthalocyanine.

Other detergent ingredients that can be included are detersive enzymes which can be included in the detergent formulations for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of *B. subtilis* and *B. licheniforms*. Proteolytic enzymes suitable for removing protein-based stains that are commercially available include those sold under the tradenames Alcalase , Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A is described in European Patent Application 130,756. Protease B is described in European Patent Application Serial No. 87303761.8.

Amylases include, for example, -amylases obtained from a special strain of *B. licheniforms,* described in more detail in British Patent Specification No. 1,296,839 (Novo). Amylolytic proteins include, for example, Rapidase, Maxamyl (International Bio-Synthetics, Inc.) and Termamyl, (Novo Industries).

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from *Humicola insolens*. Suitable cellulases are also disclosed in GB-A-2, 075,028 ; GB-A-2.095,275 and DE-OS-2,247,832.

Examples of such cellulases are cellulases produced by a strain of Humicola insolens (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (*Dolabella auricula solander*).

Other suitable cellulases are cellulases originated from Humicola Insulens having a molecular weight of about 50KDa, an isoelectric point of 5.5 and containing 415 amino acids. Such cellulase are described in Copending European patent application No. 93200811.3, filed Mar. 19, 1993.

Especially suitable cellulase are the cellulase having color care benefits. Examples of such cellulases are cellulase described in European patent application No. 91202879.2, filed Nov. 6, 1991 Carezyme (Novo).

Suitable lipase enzymes for detergent usage include those produced by microorganisms of the Pseudomonas group, such as *Pseudomonas stutzeri* ATCC 19.154, as disclosed in British Patent 1,372,034. Suitable lipases include those which show a positive immunoligical cross-reaction with the antibody of the lipase, produced by the microorganism Pseudomonas fluorescent IAM 1057. This lipase is available from Amano Pharmaceutical Co. Ltd., Nagoya, Japan, under the trade name Lipase P "Amano," hereinafter referred to as "Amano-P".

Especially suitable Lipase are lipase such as M1 Lipase (Ibis) and Lipolase (Novo).

Peroxidase enzymes are used in combination with oxygen sources, e.g. percarbonate, perborate, persulfate, hydrogen peroxide, etc. They are used for "solution bleaching", i.e. to prevent transfer of dyes of pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT Internation Application WO 89/099813 and in European Patent application EP No. 91202882.6, filed on Nov. No. 6, 1991.

In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818. It has also been proposed to use polyols like glycerol and sorbitol. Alkoxyalcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. Nos. 4,261,868, 3,600,319, and European Patent Application Publication No. 0 199 405, Application No. 86200586.5. Non-boric acid and borate stabilizers are preferred. Enzyme stabilization systems are also described, for example, in U.S. Pat. Nos. 4,261,868, 3,600,319 and 3,519,570. Other suitable detergent ingredients that can be added are enzyme oxidation scavengers which are described in Copending European Patent aplication N 92870018.6 filed on Jan. 31, 1992. Examples of such enzyme oxidation scavengers are ethoxylated tetraethylene polyamines.

Especially preferred detergent ingredients are combinations with technologies which also provide a type of color care benefit. Examples of these technologies are cellulase and/or peroxidases and/or metallo catalysts for color maintance rejuvenation. Such metallo catalysts are described in copending European Patent Application No. 92870181.2.

In addition, it has been found that the polyamine-N-oxide containing polymers eliminate or reduce the deposition of the metallo-catalyst onto the fabrics resulting in improved whiteness benefit.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alcanols are 2-butyl-octanol which are commercially available under the trade name Isofol 12 R.

Such suds suppressor system are described in Copending European Patent application N 92870174.7 filed 10 Nov., 1992.

Especially preferred silicone suds controlling agents are described in Copending European Patent application No. 92201649.8 Said compositions can comprise a silicone/silica mixture in combination with fumed nonporous silica such as Aerosil$^R$.

The suds suppressors described above are normally employed at levels of from 0.001% to 2% by weight of the composition, preferably from 0.01% to 1% by weight.

Other components used in detergent compositions may be employed, such as soil-suspending agents soil-release agents, optical brighteners, abrasives, bactericides, tarnish inhibitors, coloring agents and/or encapsulated or more encapsulated perfumes.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4$^1$-bis-(2-diethanolamino-4-anilino-s-triazin-6-ylamino)stilbene-2:2$^1$disulphonate, disodium 4, -4$^1$-bis-(2-morpholino-4-anilino-s-triazin-6-ylaminostilbene-2:2$^1$-disulphonate, disodium 4,4$^1$-bis-(2,4-dianilino-s-triazin-6-ylamino)stilbene-2:2$^1$-disulphonate, monosodium 4$^1$,4$^{11}$-bis-(2,4-dianilino-s-triazin-6ylamino)stilbene-2-sulphonate, disodium 4,4$^1$-bis-(2-anilino- 4-(N-methyl-N-2-hydroxyethylamino)-s-triazin-6-ylamino)stilbene-2,2$^1$-disulphonate, disodium 4,4$^1$-bis-(4-phenyl-2,1,3-triazol-2-yl)-stilbene-2,2$^1$disulphonate, disodium 4,4$^1$bis(2-anilino-4-(1-methyl-2-hydroxyethylamino)-s-triazin-6-ylamino)stilbene-2,2$^1$disulphonate and sodium 2(stilbyl-4$^{11}$-(naphtho- 1$^1$,2$^1$:4,5)-1,2,3-triazole-2$^{11}$-sulphonate.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned US Patent Nos. 4116885 and 4711730 and European Published Patent Application No. 0 272 033. A particular preferred polymer in accordance with EP-A-0 272 033 has the formula $$(CH_3(PEG)_{43})_{0.75}(POH)_{0.25}[T—PO)_{2.8}(T—PEG)_{0.4}]T(PO—H)_{0.25}((PEG)_{43}CH_3)_{0.75}$$

where PEG is —$(OC_2H_4)O$—, PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1–2 propane diol, the end groups consisting primarily of sulphobenzoate and secondarily of mono esters of ethylene glycol and/or propane-diol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1–2 diol, thereof consist "secondarily" of such species.

The selected polyesters herein contain about 46% by weight of dimethyl terephtalic acid, about 16% by weight of propane -1.2 diol, about 10% by weight ethylene glycol about 13% by weight of dimethyl sulfobenzoid acid and about 15% by weight of sulfoisophtalic acid, and have a molecular weight of about 3.000. The polyesters and their method of preparation are described in detail in EPA 311 342.

The detergent compositions according to the invention can be in liquid, paste, gels or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "concentrated form", in such case, the liquid detergent compositions according to the present invention will contain a lower amount of water, compared to conventional liquid detergents. Typically, the water content of the concentrated liquid detergent is less than 30%, more preferably less than 20%, most preferably less than 10% by weight of the detergent compositions. Other examples of liquid compositions are anhydrous compositions containing substantially no water. Both aqueous and non-aqueous liquid compositions can be structured or non-structured.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. and higher temperatures. The pH of the treatment solution is preferably from 7 to 11, especially from 7.5 to 10.5.

The process and compositions of the invention can also be used as detergent additive products.

Such additive products are intended to supplement or boost the performance of conventional detergent compositions.

The detergent compositions according to the present invention include compositions which are to be used for cleaning substrates, such as fabrics, fibers, hard surfaces, skin etc., for example hard surface cleaning compositions (with or without abrasives), laundry detergent compositions, automatic and non automatic dishwashing compositions.

The following examples are meant to exemplify compositions of the present invention, but are not necessarily meant to limit or otherwise define the scope of the invention, said scope being determined according to claims which follow.

A liquid detergent composition according to the present invention is prepared, having the following compositions:

TABLE I

| | % by weight of the total detergent composition |
|---|---|
| Fatty acid | 10 |
| Oleic acid | 4 |
| Citric acid | 1 |
| NaOH | 3.4 |
| Propanediol | 1.5 |

TABLE I-continued

| | % by weight of the total detergent composition |
|---|---|
| Ethanol | 10 |

EXAMPLE I

The extent of dye transfer from different colored fabrics was studied using a launder-o-meter test that simulates a 30 min wash cycle. The launder-o-meter beaker contains 200 ml of a detergent solution, a 10cm×10 cm piece of the colored fabric and a multifiber swatch which is used as a pick-up tracer for the bleeding dye. The multifiber swatch consists of 6 pieces (1.5 cm×5 cm each) of different material (polyacetate, cotton, polyamide, polyester, wool and orlon) which are sewn together.

The extent of dye transfer is assessed by a Hunter Colour measurement. The Hunter Colour system evaluates the colour of a fabric sample in terms of the ΔE value which represents the change in the Hunter L, a, b, values which are determined by reflecting spectrometrie. The ΔE value is defined by the following equation:

$$\Delta E=\{(a_f-a_i)^2+(b_f-b_i)^2+(L_f-L_i)^2\}^{1/2}$$

where the subscripts i and f refer to the Hunter value before and after washing in the presence of the bleeding fabric, respectively. The least significant difference is 1 at 95% confidence level.

Example I demonstrates the enhanced dye transfer inhibiting performance of the nonionic surfactants in combination with the polyamine N-oxide containing polymers.

The surfactant that is used is a nonionic surfactant manufactured by Shell and sold under the Tradename Dobanol. The dye transfer inhibiting performance was determined by measuring the whiteness of textile items washed with compositions containing the nonionic and/or the polyamine N-oxide containing polymers.

Experimental conditions:

pH=7.8 Washing temperature 40° C.

A. A detergent composition according to Table I which contains no nonionic and no PVNO (poly(4-vinylpyridine-N-oxide).

B: A detergent composition according to Table I which contains nonionic (Dobanol 45/11) (270 ppm) and no PVNO (poly(4-vinylpyridine-N-oxide)).

C: A detergent composition according to Table I containing 6 ppm of PVNO (poly(4-vinylpyridine-N-oxide)) which has an average molecular weight of about 10,000 and an amine to amine N-oxide ratio of 1:10 (determined by NMR).

D: A detergent composition according to Table I containing 6 ppm of PVNO (poly(4-vinylpyridine-N-oxide)) which has an average molecular weight of about 10,000 and an amine to amine N-oxide ratio of 1:10 and 270 ppm nonionic (Dobanol 45/11).

Results: ΔE values for the cotton pick-up tracer.

| Bleeding fabric composition | Bleeding fabric color | A | B | C | D |
|---|---|---|---|---|---|
| 100% cotton | Direct blue 90 | 13.1 | 12 | 9.4 | 5.1 |

EXAMPLE II (A/B/C)

A liquid detergent composition according to the present invention is prepared, having the following compositions:

| % by weight of the total detergent composition | A | B | C |
|---|---|---|---|
| Linear alkylbenzene sulfonate | 10 | — | — |
| Alkyl alkoxylated sulfate | — | 9 | — |
| Polyhydroxy fatty acid | — | — | 9 |
| Trimethyl ammonium chloride C12–C14 | — | — | 4 |
| Alkyl sulphate | 4 | 4 | 4 |
| Fatty alcohol ($C_{12}$–$C_{15}$) ethoxylate | 12 | 12 | 12 |
| Fatty acid | 10 | 10 | 10 |
| Oleic acid | 4 | 4 | 4 |
| Citric acid | 1 | 1 | 1 |
| Diethylenetriaminepentamethylene Phosphonic acid | 1.5 | 1.5 | 1.5 |
| NaOH | 3.4 | 3.4 | 3.4 |
| Propanediol | 1.5 | 1.5 | 1.5 |
| Ethanol | 10 | 10 | 10 |
| Ethoxylated tetraethylene pentamine | 0.7 | 0.7 | 0.7 |
| Poly(4-vinylpyridine)-N-oxide | 0–1 | 0–1 | 0–1 |
| Thermamyl | 0.13 | 0.13 | 0.13 |
| Carezyme | 0.014 | 0.014 | 0.014 |
| FN-Base | 1.8 | 1.8 | 1.8 |
| Lipolase | 0.14 | 0.14 | 0.14 |
| Endoglucanase A | 0.53 | 0.53 | 0.53 |
| Suds supressor (ISOFOL[r]) | 2.5 | 2.5 | 2.5 |
| Minors | | up to 100 | |

EXAMPLE III (A/B/C)

A compact granular detergent composition according to the present invention is prepared, having the following formulation:

| % by weight of the total detergent composition | A | B | C |
|---|---|---|---|
| Linear alkyl benzene sulphonate | 11.40 | — | — |
| Alkyl alkoxylated sulfate | — | 10 | — |
| Polyhydroxy fatty acid | — | — | 9 |
| Trimethyl ammonium chloride C12–C14 | — | — | 4 |
| Tallow alkyl sulphate | 1.80 | 1.80 | 1.80 |
| $C_{45}$ alkyl sulphate | 3.00 | 3.00 | 3.00 |
| $C_{45}$ alcohol 7 times ethoxylated | 4.00 | 4.00 | 4.00 |
| Tallow alcohol 11 times ethoxylated | 1.80 | 1.80 | 1.80 |
| Dispersant | 0.07 | 0.07 | 0.07 |
| Silicone fluid | 0.80 | 0.80 | 0.80 |
| Trisodium citrate | 14.00 | 14.00 | 14.00 |
| Citric acid | 3.00 | 3.00 | 3.00 |
| Zeolite | 32.50 | 32.50 | 32.50 |

-continued

| % by weight of the total detergent composition | A | B | C |
|---|---|---|---|
| Maleic acid actylic acid copolymer | 5.00 | 5.00 | 5.00 |
| Cellulase (active protein) | 0.03 | 0.03 | 0.03 |
| Alkalase/BAN | 0.60 | 0.60 | 0.60 |
| Lipase | 0.36 | 0.36 | 0.36 |
| Sodium silicate | 2.00 | 2.00 | 2.00 |
| Sodium sulphate | 3.50 | 3.50 | 3.50 |
| Poly(4-vinylpyridine)-N-oxide | 0–1 | 0–1 | 0–1 |
| Minors | | up to 100 | |

The above compositions (Example I (A/B/C) and II (A/B/C)) were very good at displaying excellent clay and detergent performance with outstanding color-care performance on colored fabrics and mixed loads of colored and white fabrics.

We claim:

1. A dye transfer inhibiting detergent composition comprising a) poly(4-vinylpyridine-N-oxide) having a ratio of amine N-oxide of from about 2:3 to about 1:1,000,000; and b) a cleaning effective amount of a surfactant system comprising a surfactant selected from nonionic, anionic, cationic, ampholytic, zwitterionic, semi-polar surfactants or mixtures thereof, wherein said composition is in the form of a granular or aqueous liquid detergent composition.

2. A dye transfer inhibiting composition according to claim 1 wherein the poly(4-vinylpyridine-N-oxide) polymer has an average molecular weight within the range of 500 to 1.000,000.

3. A dye transfer inhibiting composition according to claim 1 wherein the poly(4-vinylpyridine-N-oxide) is present at levels from 0.001 to 10% by weight of the composition.

4. A dye transfer inhibiting composition according to claim 1 wherein said surfactant system comprises a nonionic surfactant.

5. A dye transfer inhibiting composition according to claim 4 further comprising a surfactant selected from an anionic surfactant or a cationic or amphoteric surfactant or mixtures thereof.

6. A dye transfer inhibiting composition according to claim 1 which is a detergent additive, in the form of a non-dusting granule or a liquid.

7. A detergent composition which comprises a dye transfer inhibiting composition according to claim 6 further comprising builders, chelants, bleaching agents, suds suppressor, soil release agents, antiredeposition agents, optical brighteners, abrasives, bactericides, tarnish inhibitors, coloring agents, perfumes, or mixtures thereof.

8. A detergent composition which comprises a dye transfer inhibiting composition according to claim 1 further comprising builders, chelants, bleaching agents, suds suppressors, soil release agents, antiredeposition agents, optical brighteners, abrasives, bactericides, tarnish inhibitors, coloring agents, perfumes, or mixtures thereof.

* * * * *